US008483418B2

(12) United States Patent
Platz et al.

(10) Patent No.: US 8,483,418 B2
(45) Date of Patent: Jul. 9, 2013

(54) SYSTEM FOR PICKING-UP A USER'S VOICE

(75) Inventors: Rainer Platz, Colombier (CH); Wolfgang Huep, Hannover (DE)

(73) Assignee: Phonak AG, Staefa (CH)

( * ) Notice: Subject to any disclaimer, the term of this patent is extended or adjusted under 35 U.S.C. 154(b) by 154 days.

(21) Appl. No.: 13/122,846

(22) PCT Filed: Oct. 9, 2008

(86) PCT No.: PCT/EP2008/008537

§ 371 (c)(1),
(2), (4) Date: Apr. 6, 2011

(87) PCT Pub. No.: WO2010/040370

PCT Pub. Date: Apr. 15, 2010

(65) Prior Publication Data

US 2011/0243358 A1 Oct. 6, 2011

(51) Int. Cl.
*H04R 25/00* (2006.01)

(52) U.S. Cl.
USPC ..... 381/329; 381/380

(58) Field of Classification Search
USPC ..... 381/23.1, 94.1–94.2, 312–322, 328–329, 381/380, 383; 379/430
See application file for complete search history.

(56) References Cited

U.S. PATENT DOCUMENTS 5,295,193 A * 3/1994 Ono ..... 381/151
5,448,620 A * 9/1995 Gershkovich et al. ..... 455/552.1
6,661,901 B1 12/2003 Svean et al.
7,099,821 B2 8/2006 Visser et al.
7,302,074 B2 11/2007 Wagner et al.
2003/0055535 A1 3/2003 Voeller et al.
2006/0067556 A1 3/2006 Bailey et al.
2007/0147635 A1 * 6/2007 Dijkstra et al. ..... 381/94.1
2008/0188707 A1 * 8/2008 Bernard et al. ..... 600/25
2009/0209303 A1 * 8/2009 Kroll et al. ..... 455/575.2
2010/0310106 A1 * 12/2010 Blanchard et al. ..... 381/351

FOREIGN PATENT DOCUMENTS

DE 297 18 483 U1 2/1999
DE EP1377113 A2 * 1/2004
EP 1 299 988 B1 4/2003
EP 1 364 553 B1 11/2003

(Continued)

OTHER PUBLICATIONS

Parr Instrument Company, "Corrosion Resistance of Titanium", modified Feb. 3, 2006, http://www.parrinst.com/wp-content/uploads/downloads/2011/07/Parr_Titanium-Corrosion-Info.pdf.*
American Elements, "Titanium Wire", retrieved Dec. 16, 2007, http://www.americanelements.com/timw.html.*

(Continued)

*Primary Examiner* — Curtis Kuntz
*Assistant Examiner* — Joshua Kaufman
(74) *Attorney, Agent, or Firm* — Roberts Mlotkowski Safran & Cole, P.C.; David S. Safran

(57) ABSTRACT

A system for picking-up a user's voice, having an earpiece (10) that has a shell (12) and is to be worn at least partly in the user's ear canal (18), an elongate C-shaped bow-like retention element (14) attached to the shell for retaining the shell within the user's ear (18, 66, 68) and an ear microphone (16) oriented acoustically inwardly towards the user's ear canal for picking-up the user's voice. The material and the dimensions of the retention element are selected such that the retention element can be brought into engagement with the user's concha (68) by manual plastic deformation by the user.

24 Claims, 4 Drawing Sheets

FOREIGN PATENT DOCUMENTS

| | | | |
|---|---|---|---|
| EP | 1 377 113 | A2 | 1/2004 |
| EP | 1 448 014 | B1 | 8/2004 |
| EP | 1 509 065 | A1 | 2/2005 |
| EP | 1 640 972 | A1 | 3/2006 |
| WO | 2007/073818 | A1 | 7/2007 |
| WO | 2007/082579 | A2 | 7/2007 |
| WO | 2007/147416 | A1 | 12/2007 |

OTHER PUBLICATIONS

Nicol, "Practical Construction Tips for Coils Using Iron Powder Cores", Micrometals, Inc., APEC '96 San Jose, California, Mar. 5, 1996 (Revised Apr. 2, 2001), 14 pages, http://www.elnamagnetics.com/wp-content/uploads/library/Micrometals/Practical_Construction_Tips_For_Coils_Using_Iron_Powder_Cores.pdf.*

* cited by examiner

SYSTEM FOR PICKING-UP A USER'S VOICE

BACKGROUND OF THE INVENTION

1. Field of the Invention

The present invention relates to a system for picking up a user's voice by using an earpiece comprising a microphone.

2. Description of Related Art

For communication purposes, in particular for wireless electronic communication between or from persons exposed to a noisy environment, such as workers in industrial plants, policemen, soldiers, firemen, etc., it is desirable to have a sound pick-up system which is capable at least to some extent to separate the user's voice from ambient noise, or generally ambient sound, in order to improve the intelligibility of the person's speech to the listener, who may be one of the other persons exposed to the noisy environment or who may be a remote person.

A common approach to achieve such separation of a person's voice is the use of a boom microphone, i.e., a microphone which is placed close to the mouth, carried by a headset, helmet or any other device worn by the person. Such microphone selectively emphasizes the near field around the mouth.

Other approaches are vibration pick-up devices which are in direct contact with the throat, picking up the vibrations of the vocal chord, or which are in direct contact with the meatus wall or the outer ear canal, picking up the vibrations of the head tissue (i.e., "bone conduction" microphones) or which are in direct contact with the cheek-bone.

Devices of these types are either fairly sensitive to acoustic noise masking the speech or certain speech sounds are poorly transmitted, especially the high frequency consonant sounds necessary for good intelligibility. Furthermore, for industrial applications boom microphones have the drawbacks that they limit the freedom of movement of the user and that, when combined with a hearing protection device, they will affect the stability and hence the attenuation of the hearing protection device. Bone-conduction microphones have the drawbacks that they have a very limited audio bandwidth which limits the intelligibility of the speech and that they often have to be pressed fairly hard which causes discomfort to the user.

U.S. Pat. No. 6,661,901 B1 relates to an active hearing protection system comprising an earplug with an outer microphone for picking up ambient sound and an inner microphone which is sealed with respect to ambient sound but is open towards the inner part of the user's ear canal. In an operation mode in which separation of the user's voice from ambient noise is desired, only the inner microphone is activated while the outer microphone is not, with the signal from the inner microphone being processed by an electronics unit integrated within the earplug in order to make the user's voice highly natural and intelligible, either for the user himself or his external communication partners.

Another approach is based on a so-called "blind source separation" (BSS) algorithm in order to separate a person's voice from background noise by corresponding audio signal processing. U.S. Patent Application Publication 2003/0055535 A1 relates to the use of a BSS algorithm for separating the voice of an operator of a vehicle wheel alignment system with a voice audio interface from background noise by using a microphone array in order to avoid the necessity to use a headset. U.S. Pat. No. 7,099,821 B2 relates in a more general manner to the use of two spaced-apart microphones operated with a BSS algorithm for voice separation from background noise in audio applications. EP 1 509 065 A1 relates to a binaural hearing aid system wherein the audio signals captured by the microphone of the right ear hearing aid and the microphone of the left ear hearing aid undergo a BSS algorithm, followed by additional signal processing, in order to increase the intelligibility of speech in background noise by the user of the hearing aid system.

European Patent Applications EP 1 640 972 A1 and EP 1 969 335 A1 (which both correspond to International Patent Application Publication WO 2007/073818 A1) relate to a voice pick-up system comprising an earpiece including a first microphone oriented acoustically outwardly towards the environment and a second microphone oriented acoustically inwardly towards the user's ear canal, with an audio signal processing unit being provided for applying a BSS algorithm to the audio signals captured by the first and second microphone in order to separate the user's voice from ambient sound. Such system works particularly well, if the second microphone is bone conduction microphone for picking up the user's voice by direct contact to the wall of the user's ear canal. When using such a system, reliable retention of the earpiece in the user's ear is critical.

It is known, for example, from German Utility Model DE 297 18 483 U1, European Patent Application EP 1 448 014 B1 or International Patent Application Publication WO 2007/147416 A1 to provide an elastic C-shaped bow-like element as a retention element for hearing aids worn in or partly in the ear canal. The retention force is provided by the elastic deformation of the retention element which engages with the concha when worn by the user. Other examples of such an elastically deformable concha bow are found in European Patent Application Publication EP 1 364 553 B1 and U.S. Patent Application Publication 2006/067556 A1.

U.S. Pat. No. 7,302,074 B2 relates to a headset comprising a boom microphone, wherein the earpiece carrying the boom microphone is held in place by a retaining strap engaging with the user's pinna; the bow may be elastically deformable or, according to a less preferred embodiment, it may be plastically deformable.

European Patent Application EP 1 377 113 A2 relates to a headset comprising an earpiece to be inserted into the user's concha. The earpiece carries a boom microphone and comprises a C-shaped bow-like retention element for engagement with the user's concha, which consists of a wire within a envelope made of plastics material. According to one embodiment, the retention element has a high bending resistance without elastic resilience.

SUMMARY OF THE INVENTION

It is an object of the invention to provide for a system for picking up a user's voice comprising an earpiece which is to be worn at least partly in the user's ear canal and which comprises a microphone oriented acoustically inwardly towards the user's ear canal, wherein reliable retention of the earpiece should be achieved without the need for providing a customized shell.

According to the invention, this object is achieved by a system and is beneficial in that, by providing the earpiece with an elongate C-shaped bow-like retention element, wherein the material and the dimensions of the retention element are selected such that the retention element can brought into engagement with the user's concha by plastic deformation by the user, the retention function of a customized earpiece can be emulated to some extent, while using a generic earpiece, by enabling the user to bend the retention element individually according to the individual shape of the outer ear, in particular, the concha. Such plastic deformation, i.e., bending, of the retention element replaces the spring effect of the elastic concha retention elements of the prior art.

Preferably, the ear microphone is a bone conduction microphone abutting a wall of the ear canal when the earpiece is worn by the user.

In order to achieve optimum voice pick-up capabilities in background noise, the earpiece is provided with an ambient microphone oriented acoustically outwardly towards the environment, with the system comprising an audio signal processing unit for processing audio signals from the ear microphone and the ambient microphone by a BSS algorithm adapted to separate the user's voice from ambient sound.

For enabling full wireless communication, the earpiece comprises preferably a loudspeaker adapted to provide an external audio signal to the user's ear canal, with the system being adapted to be detachably connected to a wireless communication device, such as a radio device or a mobile phone.

Preferably, the earpiece is mechanically and electrically connected to a cable assembly designed to form a suspension loop round the upper part of the pinna for pre-fixing the earpiece prior to engagement of the retention element in the concha.

Preferably, the retention element comprises a wire core surrounded by a sleeve made of plastics material.

Further preferred embodiments of the invention are defined in the subclaims.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
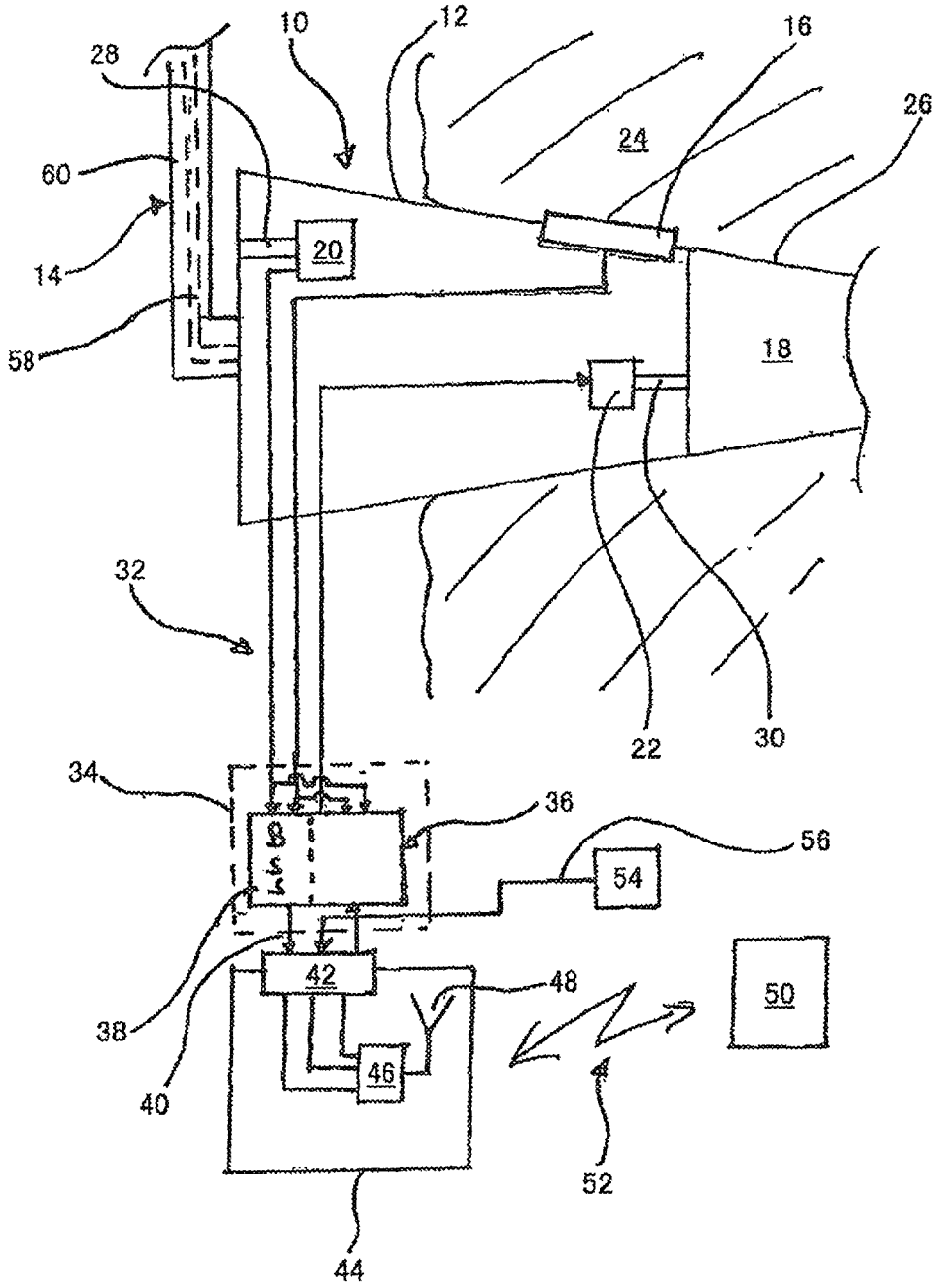
FIG. 1 shows a schematic view of an embodiment of a system according to the invention inserted into a person's ear canal, including a block diagram of the most relevant electronic components.

The system of FIG. 1 comprises an earpiece 10 which includes a shell 12, a retention element 14 attached to the shell 12 for retaining the shell 12 within the user's ear, an ear microphone 16 oriented acoustically inwardly towards the user's ear canal 18 for picking up the user's voice, an ambient microphone 20 oriented acoustically outwardly towards the environment for picking up ambient sound, and a speaker 22 for providing an external audio signal to the user's ear canal 18. The shell 12 of the earpiece is of the one-size-fits-all type, i.e., it has a standard shape (as opposed to customized shells which are individually shaped according to the shape of the user's ear).

The ear microphone 16 is a bone conduction microphone, i.e., it is adapted for picking up the user's voice via bone conduction from the user's skull 24. To this end, the ear microphone 16 abuts the wall 26 of the ear canal 18 when the earpiece is worn by the user. The necessary contact force between the microphone 16 and the wall 26 of the ear canal is provided by engagement of the retention element 14 with the user's concha, as will be explained later.

The ambient microphone 20 is open to the environment via a sound channel 28 terminating at the outer end of the shell 12. The speaker 22 is open to the inner end of the shell 12 via a sound channel 30.

The earpiece is mechanically and electrically connected to a cable assembly 32 which leads to a housing 34 containing an audio signal processing unit 36. The audio signal processing unit 36 functionally includes a unit 38 for applying a BSS algorithm to the audio signals provided by the microphones 16 and 20. Preferably, the BSS algorithm works in the frequency domain.

Generally, blind source separation (also referred to as "independent component analysis" (ICA)) is a technique for separating mixed source signals (components) which are presumably statistically independent from each other. In its simplified form, blind source separation applies an "un-mixing" matrix of weights to the mixed signals, for example, multiplying the matrix with the mixed signals, to produce separated signals. The weights are assigned initial values, and then adjusted to maximize joint entropy of the signals in order to minimize information redundancy. This weight-adjusting and entropy-increasing process is repeated until the information redundancy of the signals is reduced to a minimum. Because this technique does not require information on the source of each signal, it is referred to as "blind source separation". An introduction to blind source separation is found, for example, in U.S. Pat. No. 7,099,821 B2.

In the most simple case, BSS is applied to two different mixtures of two (acoustic) sources, wherein the two different mixtures are obtained by using two spaced apart microphones. Mixing of the two sources can be represented by a matrix A, with the BSS algorithm corresponding mathematically to finding the inverse matrix of A without knowing anything about the matrix nor about the sources, except that they are statistically independent. In the case of a person's voice mixed with background noise, the latter assumption usually is valid. The mixtures of the two sources could be different with respect to amplitude and/or phase of the two sources. In other words, by picking up sound signals with two differently oriented microphones the signal of each of these microphones will correspond to a mixture which is different with regard to the difference in amplitude and/or phase of the two acoustic sources (i.e. user's voice on the one hand and ambient noise on the other hand). By orienting one of the microphones outwardly towards the environment and the other microphone inwardly to the ear canal, a particularly large difference between the two mixtures can be obtained in a simple and particularly comfortable manner, i.e., no boom microphones or bone-conduction microphones which would cause discomfort to the user need to be used.

The audio signal processing unit 36 is connected via a cable 40 and an interface 42 to an audio input of a wireless communication device 44, usually a radio device or a mobile phone, which includes a transmitter/receiver 46 and an antenna 48. Usually the interface 42 provides for a detachable connection to the communication device 44 and is designed as a plug connector. The communication device 44 is for communicating with a remote device 50 via a wireless link 52.

The system also includes a push-to-talk (PTT) button 54 which is connected via a cable 56 to the housing 34 and from there to the interface 42 in order to control the transmitter/receiver 46 of the communication device 44.

The BSS unit 38 serves to separate the user's voice from ambient sound in order to transmit the user's voice to the remote device 50. Audio signals received from the remote device 50 by the communication device 44 are supplied, via the speaker 22, to the ear canal 18.

Usually the system is powered by the communication device 44, i.e., it does not comprise a battery.

The retention element 14 is designed such that it can be brought into engagement with the user's concha by plastic deformation by the user. This function is realized by selecting the material and the dimensions/geometry of the retention element 14 accordingly. Thus, the retention element 14 can be brought by the user into a shape which conforms best with the individual shape of the user's ear, thereby emulating the retention function of a customized, i.e. individually shaped, shell to some extent. Hence, in the present case, the retention function is primarily provided by a plastic, i.e., permanent, deformation of the retention element, which has only a very small residual springiness, and hence only a very small residual elastic spring effect, in contrast to common solutions which use a retention element which is designed to provide for retention by an elastic spring effect.

Preferably, the retention element 14 comprises a metal wire core 58 surrounded by a sleeve 60 made of plastics material. Preferably, the metal wire core is made of titanium and has a diameter of 0.6 to 1 mm. The tensile strength of the material of the wire core 58 preferably is from 300 to 900 N/mm$^2$, more preferably from 400 to 600 N/mm$^2$, with a yield strength Rp 0.2 (also termed a 0.2% yield strength) of from 200 to 800 N/mm$^2$, more preferably from 300 to 500 N/mm$^2$. The plastic sleeve 60 preferably is made of silicone. Generally, the retention element 14 should be made of a biocompatible and corrosion-resistant material. The free end of the retention element 14 is preferably covered by the plastics material PA 6.6. For a given material, the diameter of the wire core has to be selected such that, on the one hand, it can be plastically deformed by the typical manual bending force applied by the user (this requirement implies an upper limit of the diameter) and that, on the other hand, it remains stable in the plastically deformed position when fixed in the concha as long as the user does not apply a manual bending force (this requirement implies an lower limit of the diameter).

Figure 2:
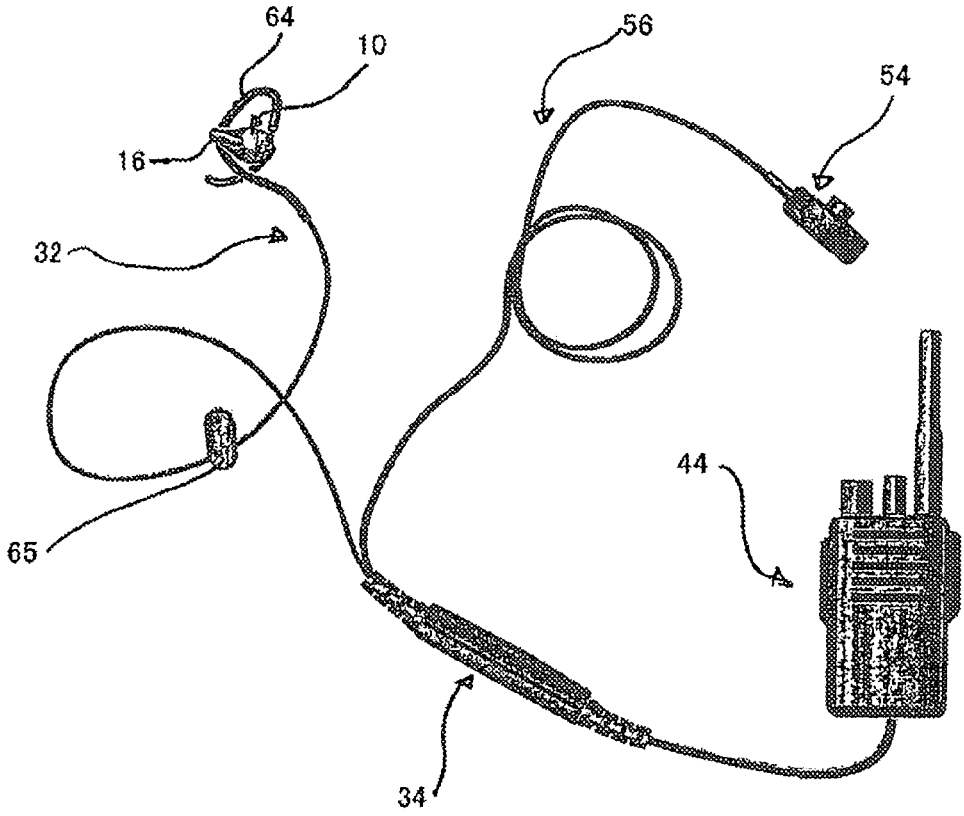
FIG. 2 is a view of an embodiment of a system according to the invention when used with a radio device.
Figure 3:
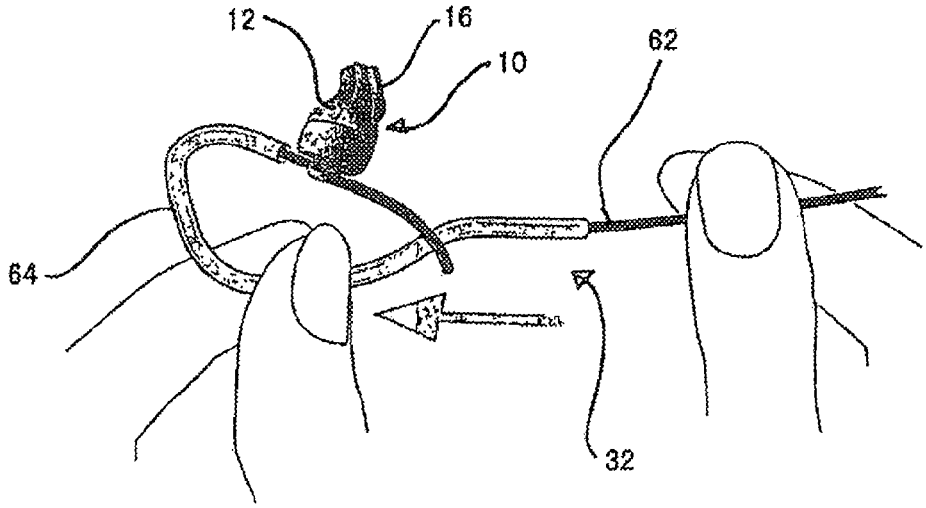
FIG. 3 is an enlarged view of the earpiece of the system of FIG. 2.

According to FIGS. 2 and 3, the cable assembly 32 comprises an electrical cable 62 which is surrounded at an end portion facing the earpiece 10 by a fastening sleeve 64 having a bent shape and being made of a plastics material. The fastening sleeve 64 can be moved along the cable 62 (see, FIG. 3) in order to enable the user to find an optimum position of the fastening sleeve 64. The fastening sleeve 64 is designed to form a suspension loop around the upper part of the user's pinna for pre-fixing the earpiece 10 prior to engagement of the retention element 14 in the user's concha. The cable assembly 32 also comprises a clip 65 for fixing the cable assembly 32 somewhere at the user's clothing.

FIGS. 4A to 4D show how the earpiece 10 of FIGS. 2 and 3 can be fixed at the user's ear.

Figure 4A:
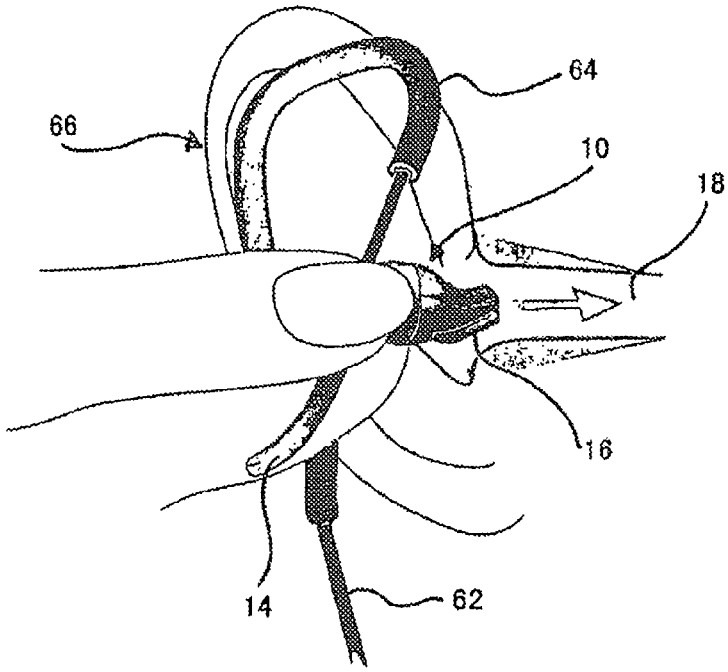
FIGS. 4A to 4D show different steps when fixing the earpiece of FIG. 3 at a person's ear.
Figure 4B:
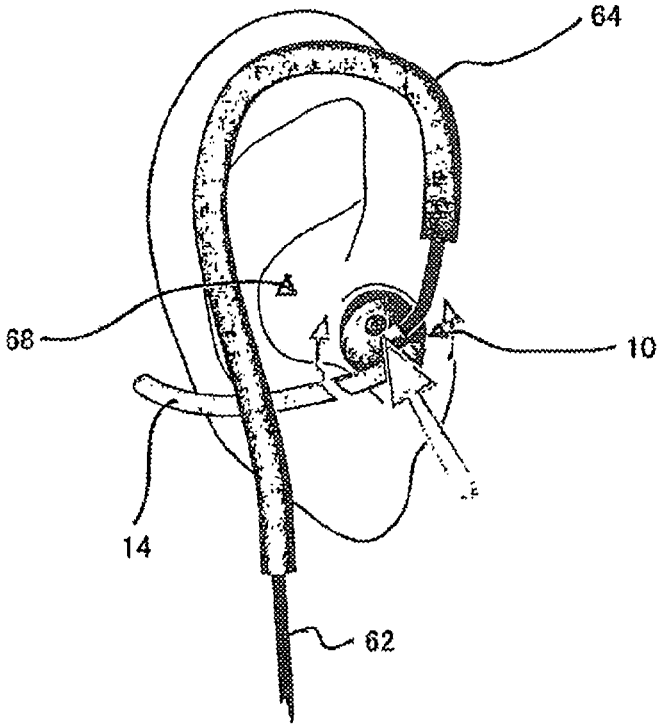
Figure 4C:
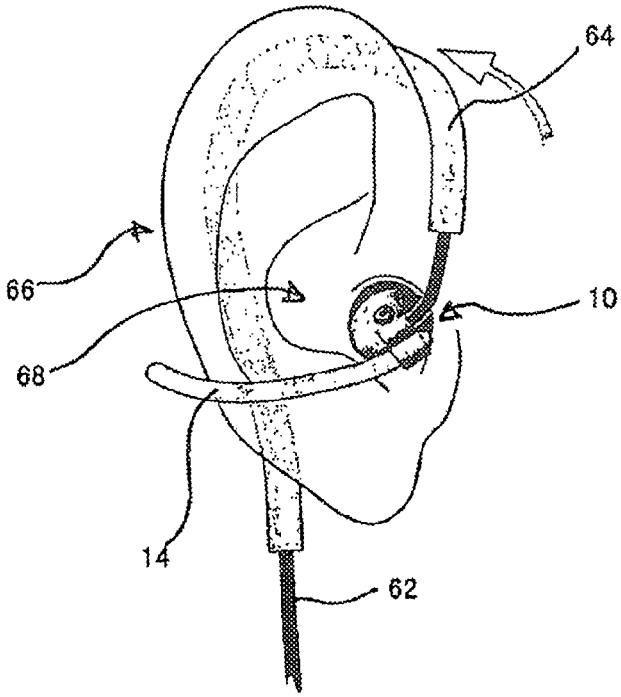
Figure 4D:
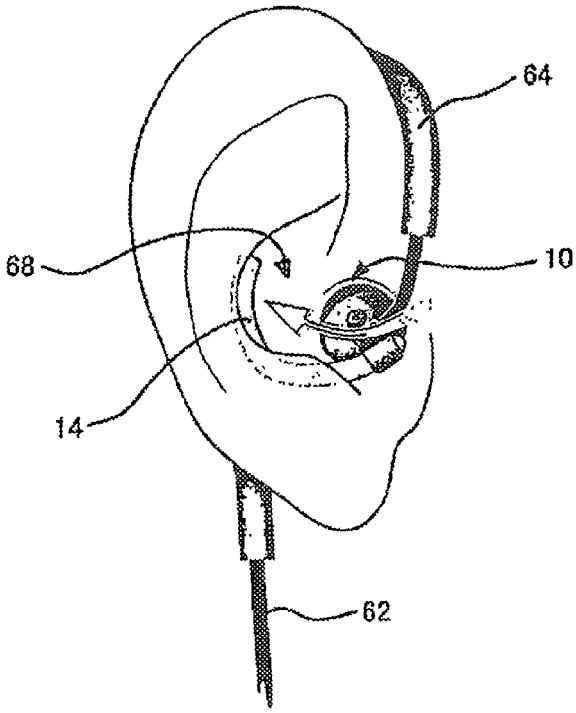

First, the earpiece 10 is inserted into the ear canal 18 as far as possible (see FIGS. 4A and 4B). Then, the fastening sleeve 64 is moved over the upper rim of the user's pinna 66 in such a manner that the fastening sleeve 64 is suspended between the pinna 66 and the skull 24 (see FIG. 4C). Thereby, the earpiece 10 is pre-fixed.

Finally, the retention element 14 is bent manually by the user into a C-like shape by plastic deformation and is brought into engagement with the user's concha 68 in order to finally fix the earpiece 10 in the use position (see FIG. 4D), thereby providing for the necessary contact force between the ear microphone 16 and the wall 26 of the ear canal 18.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A system for picking-up a user's voice, comprising an earpiece to be worn at least partly in a user's ear canal, comprising a shell, an elongate C-shaped bow-like retention element attached to the shell for retaining the shell within a user's ear and an ear microphone oriented acoustically inwardly towards the user's ear canal for picking-up a user's voice, wherein the retention element is made of a material and has dimensions that enable the retention element to be brought into engagement with a user's concha by manual plastic deformation thereof by the user and being able to remain stable in a plastically deformed position holding the ear piece at least partly in the user's ear canal, said material being a wire core surrounded by a sleeve made of a plastics material and said dimensions comprising the wire core having a diameter of 0.6 to 1 mm.

2. The system of claim 1, wherein the ear microphone is adapted for picking-up user's voice via bone conduction from a user's skull.

3. The system of claim 2, wherein the ear microphone is for abutting a wall of the ear canal when the earpiece is worn by the user, and wherein the retention element is designed to provide, when having been brought into engagement with the user's concha, a necessary contact force between the ear microphone and the wall of the ear canal.

4. The system of claim 1, wherein the wire core is made of titanium.

5. The system of claim 1, wherein a tensile strength of a material of the wire core is from 300 to 900N/mm$^2$.

6. The system of claim 5, wherein the tensile strength of the material of the wire core is from 400 to 600N/mm$^2$.

7. The system of claim 1, wherein a yield strength Rp 0.2 of a material of the wire core is from 200 to 800 N/mm$^2$.

8. The system of claim 7, wherein the yield strength Rp 0.2 of the material of the wire core is from 300 to 500 N/mm$^2$.

9. The system of claim 1, wherein the plastic sleeve is made of silicone.

10. The system of claim 1, wherein the retention element is made of biocompatible material.

11. The system of claim 1, wherein the retention element is made of corrosion resistant material.

12. The system of claim 1, wherein the earpiece is mechanically and electrically connected to a cable assembly that forms a suspension loop for mounting around an upper part of a pinna for pre-fixing the earpiece prior to engagement of the retention element in the concha.

13. The system of claim 12, wherein the cable assembly comprises an electrical cable which is surrounded, at an end portion facing the earpiece, by a fastening sleeve having a bent shape.

14. The system of claim 1, wherein the earpiece comprises an ambient microphone oriented acoustically outwardly away from the user and wherein the system comprises an audio signal processing unit for processing audio signals from the ear microphone and the ambient microphone by a blind source separation algorithm adapted to separate the user's voice from ambient sound.

15. The system of claim 14, wherein the audio signal processing unit is located in a housing which is separate from the earpiece and which is connected to the ear microphone and the ambient microphone via a cable connection.

16. The system of claim 1, wherein the earpiece comprises a loudspeaker adapted to provide an external audio signal to the user's ear canal.

17. The system of claim 1, wherein the system comprises an output plug for detachably connecting the system to a wireless communication device.

18. The system of claim 17, wherein the system is designed to be powered by the wireless communication device.

19. The system of claim 17, wherein the wireless communication device is a radio or a mobile phone.

20. The system of claim 19, wherein the system comprises a push-to-talk (PTT) button.

21. A method of using a system for picking-up a user's voice, comprising an earpiece to be worn at least partly in a user's ear canal, comprising a shell, an elongate C-shaped bow-like retention element attached to the shell for retaining the shell within a user's ear and an ear microphone oriented acoustically inwardly towards the user's ear canal for picking-up a user's voice, wherein the retention element is made of a material and has dimensions that enable the retention element to be brought into engagement with a user's concha by manual plastic deformation by the user and is able to remain stable in a plastically deformed position holding the ear piece at least partly in the user's ear canal, comprising the following steps:

using a wire core having a diameter of 0.6 to 1 mm surrounded by a sleeve made of a plastics material for said retention element, inserting the earpiece at least partly into the ear canal bringing the retention element into engagement with the user's concha by manual plastic deformation thereof by the user so as to fix the ear piece at least partly in the user's ear canal.

22. Method according to claim 21, comprising, between the steps of inserting the earpiece at least partly into outer end of the ear canal, and bringing the retention element into engagement with the user's concha by manual plastic deformation by the user, the further step of inserting a fastening sleeve, having a bent shape and which is provided on an electrical cable at an end portion thereof that faces the earpiece, into a space between the pinna and a skull.

23. Method according to claim 21, comprising the further steps of picking up sound by an ear microphone acoustically oriented inwardly towards the user's ear canal for picking-up a user's voice to create a first audio signal and by an ambient microphone acoustically oriented outwardly away from the user to create a second audio signal, and processing the first and second audio signals by a blind source separation algorithm in order to produce a processed audio signal wherein the user's voice is separated from ambient sound.

24. Method according to claim 21, wherein the processed audio signal is provided to another person by connecting the system to a wireless communication device.

* * * * *